United States Patent [19]

Fredenucci

[11] Patent Number: 4,710,422

[45] Date of Patent: Dec. 1, 1987

[54] PROCESS FOR THE TREATMENT OF A FIBROUS SHEET OBTAINED BY PAPERMAKING PROCESS, WITH A VIEW TO IMPROVING ITS DIMENSIONAL STABILITY, AND APPLICATION OF SAID PROCESS TO THE FIELD OF FLOOR AND WALL-COVERINGS

[75] Inventor: Pierre Fredenucci, Charavines, France

[73] Assignee: Arjomari-Prioux, Paris, France

[21] Appl. No.: 819,349

[22] Filed: Jan. 16, 1986

[30] Foreign Application Priority Data

Jan. 18, 1985 [FR] France ..... 85 00745

[51] Int. Cl.[4] ..... B32B 7/00; B05D 3/02

[52] U.S. Cl. ..... 428/248; 427/389.9; 427/391; 427/392; 427/393.1; 427/393.4; 428/265; 428/288

[58] Field of Search ..... 427/389.9, 392, 391, 427/393.1, 393.4; 428/240, 265, 288, 289

[56] References Cited

U.S. PATENT DOCUMENTS

| | | | |
|---|---|---|---|
| 1,995,623 | 3/1935 | Richter | 91/70 |
| 2,801,937 | 8/1957 | Hess | 117/140 |
| 2,898,313 | 7/1959 | Ericks | 260/17.2 |
| 3,884,685 | 5/1975 | Green, Jr. et al. | 162/138 |
| 4,045,262 | 8/1977 | Enzinger et al. | 156/62.2 |
| 4,230,746 | 10/1980 | Nahta | 427/393.3 X |
| 4,291,101 | 9/1981 | Tanizaki | 428/514 |
| 4,341,597 | 7/1982 | Andersson | 162/127 |
| 4,487,657 | 12/1984 | Gomez | 162/158 |

FOREIGN PATENT DOCUMENTS

| | | |
|---|---|---|
| 1195562 | 10/1982 | Canada . |
| 0018961 | 11/1980 | European Pat. Off. . |
| 0042259 | 12/1981 | European Pat. Off. . |
| 770730 | 3/1957 | United Kingdom . |

*Primary Examiner*—Thurman K. Page
*Attorney, Agent, or Firm*—Bacon & Thomas

[57] ABSTRACT

The invention relates to a treatment process for improving the dimensional stability of a fibrous sheet obtained by papermaking process, and of which at least part of the fibers are cellulosic fibers, said process consisting in impregnating the sheet with a chemical composition containing at least one wetting agent and one binder.

4 Claims, No Drawings

PROCESS FOR THE TREATMENT OF A FIBROUS SHEET OBTAINED BY PAPERMAKING PROCESS, WITH A VIEW TO IMPROVING ITS DIMENSIONAL STABILITY, AND APPLICATION OF SAID PROCESS TO THE FIELD OF FLOOR AND WALL-COVERINGS

The present invention is concerned with improving the dimensional stability of a fibrous sheet by applying on said sheet of a solution of chemical compounds and then drying.

"FIBROUS SHEET" is here understood to mean a material prepared by paper making processes and comprising fibers part at least of which are cellulosic fibers; this material may, if necessary, further include an organic and/or inorganic non-binding filler, an organic binder and one or more adjuvants normally used in papermaking.

For some applications, in particular floor- and wall-coverings, placards and offset printing papers, it is known that paper-makers and converters require a higher dimensional stability towards water or ambient moisture In the field of floor-coverings, new supports have been used for some years to replace asbestos boards which were stable towards water and moisture, but hazardous for users' health. These replacement products are glass webs and asbestos-free mineral sheets.

Mineral sheets, although being more economical for the converters, are less stable dimensionally, than glass webs which are at least as stable as asbestos sheets towards water and moisture.

The bad dimensional stability of mineral sheets is essentially due to the presence of the cellulosic fibers that they contain. These fibers being very hydrophilic, their sizes depend very much on the moisture content of the atmosphere.

Papermakers have done a lot of research with a view to improving the dimensional stability of such fibrous sheets.

It is known to impregnate cellulosic supports with resins of the melamin-formaldehyde type which can, to some extent, limit the moisture regain of the cellulosic fibers and therefore increase the dimensional stability. But the improvement thus obtained is still poor ("Papiers - cartons - films - Complexes" FRANCE—June 1979 p. 14).

It is also known that some improvement may be obtained by replacing cellulosic fiber with increasing amounts of hydrophobic fibers such as, in particular, mineral fibers and especially glass fibers or rock wool, and, to some extent, organic synthetic fibers.

But anyone skilled in the art knows that large quantities of glass fibers are detrimental to:

the look-through of the sheet being made on the machine, the aspect of the sheet surface which may be responsible for the defects occurring during the subsequent transformation of the sheet, such as picking and releasing of fibers during the coating process with a plastic compound It is also known that improvement of the dimensional stability may be obtained independently of the proportion of hydrophobic fibers by chemical processing of fibrous sheet using wetting agents which render the cellulosic fibers water-and moisture-repellent. A suitable compound used by papermakers, are polyethyleneglycol (thereafter called PEG) which is mentioned in "Papiers - Cartons - Films - Complexes" June 1979 p. 14–16. Other compounds of the same group formed by polyglycols and their derivatives are described for the same use in U.S. Pat. No. 4,291,101 of Nippon Oil and Fats Co. (polyoxyalkylene glycol monoacrylates and polyoxyalkylene glycol monomethacrylates) and in European patent No. 18 961 of ROCKWOOL AB (polyoxyalkylenes).

But anyone skilled in the art knows that, in the field of wall- or floor-covering supports, the amount of wetting agents, in particular PEG, applied must be limited, because of the loss of mechanical properties of the sheets impregnated with such products and because of the difficulties which occur in the later transformation of the sheet support with a synthetic layer, such as plastisol (PVC+plasticizers) (EP. No. 18 961):

blistering on the synthetic layer applied on the support during the curing which provides the expansion of the synthetic layer (160° C.–200° C.) due to the thermal degradation of the chemical wetting agents such as PEG.

inhibition of the synthetic layer expansion hence a non-uniform thickness in the expanded synthetic layer, peeling tendency between the support and the plastic layer.

The quantities of wetting agents suitable for impregnating the fibrous sheet being limited, this also limits the possibility of improving dimensional stability towards these chemical compounds.

Therefore, all the aforesaid techniques have, heretofore, never made it possible, without great problems, to improve sufficiently the dimensional stability of mineral sheets compared to that of glass webs.

It is also known to impregnate cellulosic support sheets with binding and wetting agents for other purposes than for improving dimensional stability.

The wetting agent may indeed, as surface-active product, be used for altering the characteristics of the binder.

Wetting agents may be used for example to improve the coating of the binders on the papermaking fibers (see FR-1 250 132), to soften the latex- or bitumen-impregnated paper (see FR-2 481 333 and U.S. Pat. No. 2,801,937), or simply to lower the surface tension of hydrophobic materials contained in latex- or bitumen-impregnated papers or non-woven materials, in order to increase their absorbing power towards liquids (see E.P. No. 42 259, U.S. Pat. No. 1,995,623 and GB No. 770 730).

But none of the aforesaid documents is really concerned with obtaining a noticeable improvement of the dimensional stability other than what the papermakers already know on the effects of wetting agents. And in fact, in the prior art, the quantities of wetting agents used remain low compared with the weight of binder.

It is one object of the invention to improve the dimensional stability of coating supports for floor- and wall-coverings by using a new chemical treatment.

Another object of the invention is, for equal dimensional stability, to reduce the proportion of mineral fibers used in supports for floor- and wall-coverings.

Yet another object of the invention is to improve the dimensional stability of other papermaking supports containing cellulosic fibers.

According to the invention, it has been found that the dimensional stability of a fibrous sheet towards water and moisture is remarkably increased if the fibrous sheet containing cellulosic fibers is impregnated with a chemical composition containing at least a binder and at least a wetting agent, the impregnated sheet being thereafter dried.

It was indeed unexpectedly found that a clearly higher dimensional stability than that which could have been obtained by impregnation of the fibrous sheet with a wetting agent alone or a latex alone, was reached with a mixture of wetting agent and binder, and that the resulting stability is higher than what could have been expected by adding the two effects.

The result is all the more unexpected that in fact, binders alone bring little if any improvement in the dimensional stability of the fibrous sheet.

Although it has not been possible to identify the exact mechanisms of the synergistic action of the wetting agent and of the binder, it does seem that the quantities of wetting agent used are sufficient to allow a satisfactory wetting of the cellulose, in addition to any fixation of a certain quantity of wetting agent on the binder.

The binder to use is an organic binder of natural or synthetic origin because mineral binders and cements have the disadvantage of taking too long to set. The organic binder guarantees the binding together of the constituents of the fibrous sheet and can reinforce the physical properties of the papermaking sheet.

The binder according to the invention is a synthetic latex, such as for example:

SBR polymers
Acrylic polymers
PVC polymers
Vinylacetate - vinylchloride - ethylene copolymers, and/or a water-soluble binder such as, for example:
starch,
polyvinylic alcohols,
polyamide/polyamine-epichlorhydrin copolymers which are generally used in papermaking processes as wet strength agents.

Preferred latex are those which have a surface tension less than 40 mN/m.

By wetting agent is meant any hygroscopic chemical product having a low surface tension and allowing the sheet to instantly regain large quantities of water even in low hygrometry ambient conditions. In doing so, the sheet remains dimensionally stable while going through a stronger hygrometry.

The wetting agent according to the invention is a chemical compound preferably of the polyglycols group, and their derivatives. Among suitable products:

the polyethylene glycols,
the polyoxyalkylenes.

According to the invention, the treatment of the fibrous sheet may be carried out directly on the paper machine or an independent impregnating or coating installation by the papermaker or by a converter.

The fibrous sheet is treated by any conventional impregnation process. Possible devices are, for example spraying devices impregnaters, but preferably size-presses which are usually to be found on paper machines.

The fibrous sheet may be impregnated on only one face but, a preferred embodiment of the invention is the impregnation on both faces.

Technically speaking, the application of the invention by impregnation or by coating will raise no special problem to anyone skilled in the art.

The invention will be more readily understood on reading the following examples given by way of information and non-restrictively.

In developing the invention, studies have been made on fibrous sheets of different compositions.

For each study, the fibrous sheet was impregnated with wetting agent alone or with binders alone. The results were then compared with those obtained on the same fibrous sheet impregnated with mixtures of wetting-agent and binder.

In the following, the proportions between wetting agents and binders are given by way of indication, and correspond, for the supports examined, to the best compromises of mechanical strengths and dimensional stability obtained.

The mixture will normally contain at least 15 parts by dry weight of wetting agent for 85 parts by dry weight of binder. But, a carefully selected binder will enable to introduce less than 15 parts of wetting agent in the impregnation composition.

Obviously, anyone skilled in the art is not limited to these proportions, and can vary them in relation to the support used and to the sought purpose, and replace all or part of the cellulosic fibers with any other hydrophilic fibers.

It is moreover possible, depending on the applications:

to combine more than one latex, particularly in order to limit the plastisol peeling problems encountered with styrene-butadiene latex, to introduce into the impregnation mixture, secondary additives commonly used in papermaking such as: pigments, dyes, dispersing agents, defoamers, fungicides, bactericides, sizing agents.

The best way to obtain the size-press compositions is, for compositions containing no water-soluble binder, to mix successively:

water
defoamer
wetting agent
synthetic latex
"Aquapel" ®

For compositions containing a water-soluble binder:

water-soluble binder
water
defoamer
wetting agent
"Aquapel" ®

STUDY No. 1

Floor and wall covering coating supports

For this first study, the different impregnations were made on a fibrous sheet which has an intermediary composition to that of sheets with high latex content such as described in two other applications of the Applicant: EP No. 100720 and EP No. 145222.

The sheet is prepared, according to the preparation process described in European patent application Nos. 6390 and 100720, from:

| | |
|---|---|
| glassfibers CPW 09-10 ® | 8.4% |
| Cellulose | 17.7% |
| Calcium carbonate | 36.9% |
| Latex DM 122 ® | 36.9% |

The sheet was impregnated in a size-press with pure wetting agents or binders, and mixtures thereof.

The coat-weight of dry material applied on the sheet was adjusted by more or less diluting the impregnation solution with water.

In order to prevent foam forming on the industrial paper machine, a defoamer was chosen and added to each size-press composition.

Finally, an alkaline sizing agent, based on dimeralkylketene, was incorporated to the impregnation solution in order to decrease the superficial water absorption of the final impregnated sheet.

The proportions of defoamer and sizing agents added to the various size-press solutions (of pure chemicals or of their mixtures) are identical.

The defoamer is added in the proportion of 0,05%, with respect to the total volume of the final solution.

The sizing agent is added in the proportion of:

5% by weight of commercial product by dry weight of wetting agent in solutions containing mixtures of wetting agents and binders.

5% by weight of commercial product by dry weight of pure wetting agent or binder in general or of commercial weight of Nadavine LT® (polyamide/polyamine-epichlorhydrin copolymer).

Part I — Impregnation with pure compounds

All the results are compiled in table I.

A. Wetting agents:

Two wetting agents were used:

PEG 400® (Molecular weight 400)

BEROCEL 404®, containing alkylene oxides and sold by the firm BEROL.

1. PEG 400

As mentioned in the Prior Art, PEGs having a low molecular weight are decomposed by increasing temperatures. To meet the requirements imposed by the application proposed for the support tested, PEG 400® was selected after several tests.

Indeed, PEG 400® shows a good efficiency for dimensional stability, and a low thermal decomposition at the temperatures used in the subsequent transformation phase. It is even possible, if the need arises, to reduce the sensitivity of PEG to temperature, by adding adapted stabilizing agents in the size-press.

The tests conducted show that, higher coat-weights of PEG 400® improve the dimensional stability of the sheet (Prufbau measurements) but the mechanical properties are considerably affected. In particular, there is a decrease of cold and hot traction forces, of rigidity and of the resistance to traction delamination (thereafter called RTD).

During stoving, the sheets become yellow, this loss of whiteness is due to the PEG.

Blistering of the plastisol layer occurs with high coat-weights of PEG 400® gelling temperature (160° C.) and at expanding temperature (200° C.).

Furthermore, higher coat-weights of PEG 400® do not remove the "hard points" from the plastisol surface which are defects due to the picking of glass fibers; indeed, the binding power of the PEG 400® solution is too weak to size the fibers on the surface of the sheet.

The coat-weight obtained with a PEG 400® solution diluted with 35% dry matter gives a better compromise between the increase in dimensional stability and the loss of mechanical characteristics. Rigidity and tractions, in particular hot tractions, are still unacceptable.

2. BEROCEL 404®:

The dimensional stability is less than that obtained, for equal coat-weights with PEG 400®.

The improvement with respect to the untreated support is insufficient. The experiments did not show that blistering was at all hindered by the sheet impregnation with BEROCEL 400®, as indicated in European patent application 18961.

At a same dimensional stability level in sheets impregnated with BEROCEL 404® or PEG 400®, BEROCEL 404® exhibits an even worse effect on the mechanical characteristics of the impregnated sheet:

loss of rigidity loss of cold tensile strength strong loss of hot tensile strength.

On this type of sheet, pure polyox alkylenes are not suitable to provide dimensional stability while avoiding the negative effects already known from the prior art.

B. Binders:

1. Synthetic latex:

Improvement of the dimensional stability compared with the non-impregnated sheet is too weak to be of any interest.

It is nevertheless found that the best results were obtained, at equivalent coat-weights and for chemically identical latex, with latex having the lower surface tension (for exemple with the Latex 3718 from the styrene-butadiene latex group).

2. Water-soluble binders:

(a) Polyamide/polyamine-epichlorhydrin polymers:

These products (Nadavine®, LT®, KYMENE 577® HV . . . ) have virtually no influence on dimensional stability and they do not damage the mechanical characteristics.

No particular difficulties appeared during the transformation phase, in particular no blistering of the plastisol.

Furthermore, the RTD values were surprisingly increased by about 100% during the transformation phase.

This result is all the more unexpected that the high coat-weights of binder heretofore necessary to increase the RTD, cause a strong blistering of the plastisol, (b) Starch and polyvinylic alcohols:

These compounds have no action on dimensional stability.

Part II — Impregnation with mixtures of wetting agents and binders

All the results are compiled in table II.

A. Wetting agents and latex:

It has been found that the impregnation of a fibrous sheet with a mixture comprising both a wetting agent and a binder, strongly increases, for the same coat-weight of wetting agent, the dimensional stability compared to impregnation with a pure wetting agent.

The results are very surprising considering that in the best conditions the latex alone only bring a slight improvement of the dimensional stability (Table I).

Comparing the results of Table I with those of Table II, it is obvious that, for an equivalent dimensional stability, the mixture of wetting agent and binder gives the possibility of considerably restricting the coat-weight values, hence of efficiently combatting the negative effects of these wetting agents for the transformation phase which will follow.

In all the examples, corresponding to a total coat-weight of 13 g of dry matter, of mixtures of latex and wetting agent or of pure wetting agents, it was found that when impregnating with a mixture of latex and wetting agent, it is possible to apply half the amount of wetting agent to obtain the same level of dimensional stability and also to considerably reinforce the mechanical characteristics, and in particular rigidity and cold and hot tractions, while eliminating the greasy touch and transparentization effect as well as the blistering problems.

From table II, it is obvious that at equivalent dimensional stability level and with the same latex, the mixtures containing PEG 400 ® make it possible to reduce the coat-weight of wetting agent and thus to obtain better physical characteristics than those obtained with polyoxyalkylenes, in particular:

improved rigidity, improved whiteness (after stoving)

improved cold and hot traction without any major risk of blistering or irregular thickness of the plastisol layer.

Due to the low coat-weight of wetting agent, another advantage of using PEG alone, over BEROCEL 404 ®, is that there is no blistering of the plastisol on sheets treated with a mixture of latex and PEG 400 ®, contrary to sheets treated with a mixture of latex and BEROCEL 404 ®.

And thereagain, it is found when comparing the results obtained with the styrene-butadiene latex that the best results are obtained with latex having the smallest possible surface tensions.

Also according to Table II, the use of mixtures containing styrene-butadiene latex causes a great reduction of RTD values compared with mixtures containing other latex.

This is due to the fact that the sheets used in this study have a low porosity and that the styrene-butadiene creates a barrier against plasticizers. The latter only penetrate very slightly when the plastisol layer is applied, hence a lesser adherence between the treated sheet and said plastisol layer.

B. Wetting agents and water-soluble binders:

1. Wetting agents and polyamide/polyamine-epichlorhydrin polymers (Nadavine LT ®):

From the results obtained with a coat-weight of 13 g/m$^2$ of dry matter of pure PEG and PEG-Nadavine ® mixture, it is clear that there is an important increase of the dimensional stability, coupled to an improvement of the rigidity, hot and cold tractions and a reduction of yellowing under heat.

The results obtained with the KYMENE ®-PEG mixture are found to be comparable to those obtained with the Nadavine ®-PEG mixture.

The results given in Table II also show that the dimensional stability and mechanical characteristics are improved when the mixture Nadavine ®-PEG is preferred to the mixture Nadavine-BEROCEL 404 ®.

2. Wetting agents and starch or polyvinylic alcohols :

According to Table II, at equivalent dimensional stability and for an equal coat-weight of dry matter, the rigidity and whiteness are improved compared to the impregnation with pure PEG 400 ®.

STUDY No. 2

Porous sheet without beat addition latex

The results are compiled in Table III.

The tested sheet was obtained from:

| | |
|---|---|
| cellulosic fibers 20° SR | 80.6% by dry weight |
| glassfibers CPW 09-10 ® | 18.4% by dry weight |
| Nadavine LT ® | 1.0% by dry weight |

This study shows that the same results as those obtained with the coating support for floor- and wall-coverings are also obtained with this type of paper.

The results obtained with this sheet were found to be the same as those obtained with the coating support for floor- and wall-coverings.

The technical and economical advantages obtained from using PEG 400 ® wetting agent having been proved in Study I, the same wetting agent was used here.

The preparation of the size-press compositions is the same as that used in Study I.

Part 1 — Impregnation with pure compounds

A high coat-weight of PEG 400 ® to an improvement of the dimensional stability but causes a loss of rigidity and hot traction compared with the characteristics of non-impregnated sheet.

Neither latex nor Nadavine LT ® give any improvment of the dimensional stability.

Part 2 — Impregnation with mixtures

1. Mixture of PEG 400 ® and Nadavine LT ®

On comparing experiments III 2 and III 6, it is obvious that, for equivalent coat-weights, of mixture or of pure wetting agent the dimensional stability is three times greater.

Moreover, rigidity and hot traction are increased and the picking of fibers on the surface of the sheet is reduced.

2. Mixture of PEG 400 ® and latex

The latex used is DM 122.

On comparing experiments III 2 and III 5, it is obvious that with a lower coat-weight of dry matter of mixture an equivalent dimensional stability is obtained.

At equivalent dimensional stability level, impregnation with the mixture makes it possible to reduce by more than half, the coat-weight of PEG 400 ® and to improve rigidity and hot traction.

The presence of latex in the impregnation composition also increases the binding power of said composition and prevents the picking of the glassfibers on the surface of the sheet.

STUDY No. 3

Placards paper required to remain stable in important variations of atmosphere The results are compiled in Table IV.

The sheet used was formed from:

| | |
|---|---|
| cellulosic fibers | 54% by dry weight |
| broke | 22% |
| glassfibers CPW 09-10 ® | 7.6% |
| carbonate PR 4 ® | 16% |
| cationic starch | 0.4% |

The mixtures were prepared according to the description of Study No. I.

Part 1 — Impregnation with pure products

Neither Nadavine LT® nor latex influences the dimensional stability.

PEG improves the dimensional stability but weakens cold traction and rigidity.

Hot traction being of no interest for this application, it was not controlled.

Part 2 — Impregnation with mixtures

The latex used is latex 3720®.

Hereagain the mixtures permit an increase of the dimensional stability with a lower PEG 400® coat-weight on the sheet.

The mixtures limit the losses in mechanical characteristics compared to those of the non-impregnated sheet.

The mixtures permit a reduction of the greasy touch of the sheet.

In sheets impregnated with a mixture of wetting agent and binder according to the invention, the evenness of the paper permits, in particular, a better rendering of plain ground printing.

STUDY No. 4

Industrial trials on coating sheets for floor- and wall-coverings

Before checking the laboratory test results two tests were made on a Fourdrinier paper-machine.

I — Test E 1183

The sheet used is a sheet with filler and high latex content obtained according to the process described in European patent No. 145 522.

The sheet is composed of:

| | |
|---|---|
| cellulosic fibers 20° SR | 12.4% |
| carbonate (OMYALITE 60 ®) | 51.6% |
| Latex DM 122 ® | 30.1% |
| glassfibers CPW 09-10 ® | 5.8% |

This sheet was impregnated on both faces in a size-press fed with a mixture of:

| | |
|---|---|
| water | 50 liters |
| Defoamer NOPCO NXZ ® | 0.15 Vol. % by total volume of the mixture |
| BEROCEL 404 ® | 50 kg |
| Latex 6171 ® | 100 kg (commercial) |
| "AQUAPEL" ® | 2.5 liters (commercial) |

Final dry weight extract 48%

The obtained coat-weight was 25 g/m2 by dry weight (total of both faces). Impregnation with a mixture of BEROCEL 404® and Latex 6171® the dimensional stability but to the detriment of the hot traction (Table V) .

On another sheet of this test (slightly different substance) the performances of impregnations with the preceding mixture were compared with a new one in which the PEG 400® had replaced the BEROCEL 404®.

To obtain the same dimensional stability, the coat-weight of BEROCEL 404®-latex mixture is twice as much as with the PEG 400®-Latex mixture (Table Vbis).

Furthermore, the PEG 400®-Latex mixture gives improved rigidity and hot traction.

This test has shown the advantage of impregnating the sheet with a mixture of PEG 400® and latex in order to improve the dimensional stability.

II — Test E 1193

The sheet used is a sheet with high latex content and no filler formed according to the process of ARJOMARI European patent applications Nos. 6390 and 100.720.

The sheet is composed of:

| | |
|---|---|
| cellulosic fibers 20° SR | 34.2% by weight |
| glassfibers CPW 09-10 ® | 15.2% |
| Latex DM 122 ® | 50.6% |

This sheet was directly impregnated on both faces in the paper machine size-press with a mixture of:

| | |
|---|---|
| water | 394 liters |
| defoamer NOPCO NXZ ® | 0.4 liters |
| PEG 400 ® | 145 kg |
| Latex 3726 ® | 290 kg (commercial) |
| "Aquapel" | 7.25 liters (commercial) |

Final dry weight extract 31%

The obtained coat-weight was 25 g/m2 by dry weight (total of both faces).

The results given in Table VI show that the dimensional stability of the sheet is considerably increased by impregnation with a mixture of PEG 400® and latex.

This impregnation causes only a slight loss of rigidity and of cold traction.

The loss of cold traction is more important but its level is still satisfactory. Also to be noted is an improvement of the RTD.

Impregnation with a mixture of PEG 400® and latex notably improves the dimensional stability without appreciably weakening the main mechanical characteristics of the sheet(TABLE VI).

STUDY No. 5

Mineral sheet for wall-coverings

This sheet is a thin sheet with filler and low latex content which is formed according to the process described in ARJOMARI's European patent application No. 6390.

For this type of application, anyone skilled in the art knows that the dimensional stability has to be as good as possible.

It was noted during a former study that the essential mechanical characteristics were much disturbed by impregnation with only a wetting agent (PEG 400®)(loss of rigidity, traction and opacity).

It was found in this study, that for this type of application, impregnation with mixtures giving lower coat-weights of wetting agents, hence disturbing less the main mechanical characteristics, leads to a good improvement of dimensional stability without the disadvantages brought by the wetting agents alone.

The basic sheet is composed of:

| | |
|---|---|
| cellulosic fibers 20° SR | 31.4% by weight |
| glassfibers CPW 09-10 ® | 4.7% |
| Carbonate PR 4 ® | 58.1% |
| Latex SBR 86815 ® | 5.8% |

The dimensional stability was measured with a Fenchel device. The test bar was stoved for 2 minutes at 200° C. before the test and then the elongation was measured by immersing a bar for 8 minutes in water.

The dimensional stability of the basic sheet is 0.58%.

Impregnation 1

The size-press mixture contains:

| | |
|---|---|
| water | 100 g |
| defoamer NOPCO NXZ ® | 0.4 g |
| PEG 400 ® | 100 g |
| Latex 3726 ® | 185 g (commercial) |
| "Aquapel" ® | 5 g |

Final dry weight extract 30%

The dry coat-weight was 10.3 g/m2 (total of both faces).

The dimensional stability is then 0.35%, namely an increase of over 50% compared with the basic sheet.

Impregnation 2

The latex 3726 in the mixture of Impregnation 1 was replaced with an equivalent quantity of Latex CE35 ®.

The final dry weight extract of the mixture was 30%

The dry coat-weight was 11 g/m2 (total of both faces).

The dimensional stability is 0.27%, namely another very important increase in dimensional stability.

Impregnation 3

In the mixture, the latex is now replaced with Nadavine LT ®.

The mixture contains:

| | |
|---|---|
| water | 245 g |
| Nadavine LT ® | 100 g (commercial) |
| PEG 400 ® | 100 g (commercial) |
| "Aquapel" ® | 5 g |

Final dry weight extract 25%.

The dry coat-weight was 11.1 g/m2 (total of both faces)

The dimensional stability is once more 0.27%

STUDY No. 6

INFLUENCE OF IMPREGNATION ON THE GLASSFIBER CONTENT

For certain applications, a high dimensional stability is necessary and can only be obtained by adding large quantities of reinforcing glassfibers in the mass of the paper.

Such large quantities of reinforcing fibers may create certain technical problems, depending on the final use of the resulting paper, or economical problems due to the cost of certain types of reinforcing fibers such as for example polyester fibers.

The object therefore will be to obtain the level of dimensional stability wanted for the final sheet while limiting the quantities of reinforcing fibers introduced therein.

Taking for example glassfibers, the papermaker knows that these fibers improve the dimensional stability of papermaking sheets; they are used to this effect in particular in the composition of coating supports for floor- and wall-coverings and placards. But the papermaker also knows that it is not good to add too large quantities of glassfibers (as indicated at the beginning of the description).

Therefore a comparative study was carried out in order to show the advantage of the chemical process according to the invention in reducing the glassfiber content while maintaining, and even improving, the dimensional stability of the papermaking sheet.

The support sheets are obtained with:

25 parts by dry weight of cellulosic fibers, 50 parts by dry weight of chalk, 2.5 to 4 parts by dry weight of glassfibers 5 parts by dry weight of latex.

The results of this Study are compiled in Table VII.

It was found that :

the dimensional stability is really dependent on the glassfiber content in the sheets non-treated according to the invention, and that the dimensional stability of the supports containing 2.5 parts of glassfibers and impregnated according to the invention is greatly increased over that of the non-impregnated support and containing 4 parts of glassfibers.

STUDY No. 7

Influence Of The Wetting Agent/Binder Ratio On The Level Of Dimension Stability

In the field of floor- and wall-coverings, it is known that, due to the release of volatile products such as moisture contained in the support, blistering of the synthetic material coated on the support occurs at the temperatures used in the treatment conducted in order to cause pre-gelling or expanding of said material (160°-200° C).

In the tests conducted in order to check the effects of the wetting agents used in the impregnation mixtures according to the invention, the wetting agent/binder ratio was different in each mixture and the different wetting agents were compared.

The results of this Study are compiled in Table VIII.

It is clear for these results that:

(a) For mixtures of a given wetting agent and binder, a reduction of the wetting agent/binder ratio eliminates the blistering phenomenon while maintaining a neatly increased dimensional stability compared with the non-impregnated support.

(b) With the same binder, the same coat-weight and comparable wetting agent/binder ratios, dimensional stability is improved and blistering is substantially equivalent if the PEG 400 ® is replaced with PEG 600 ®.

(c) In the same conditions of use as in paragraph (b), the BEROL 404 ® gives equally good results as PEG 400 ® and PEG 600 ® as regards blistering but BEROL 404 ® is less efficient as the other two in improving dimensional stability.

Test VIII-4 shows that the quantity of PEG 400 ® can be considerably reduced while a notably increased stability is obtained compared with the non-impregnated support.

STUDY 8

Influence Of The Selected Latex On Dimensional Stability

This study shows that all latex have not the same efficiency in improving dimensional stability according to the treatment process object of this invention.

Impregnation tests have been conducted with the same basic mixture containing 15 parts by dry weight of PEG 400® and 85 parts by dry weight of latex.

The support to be impregnated is the same in all the tests. It is an industrial support for a wall-covering (E 1235 IN 3) of which the gsm substance is 154 g/m2, having the following composition:

25 parts by dry weight of cellulosic fibers (20° SR)
4 parts by dry weight of glassfibers
50 parts by dry weight of styrene butadiene latex The dry coat-weight is 15 g/m2 of dry product for each test.

The results are compiled in Table IX.

It is found that:

depending on the chemical nature of the latex, at for an equivalent surface tension, the level of dimensional stability obtained may differ, and that:

with latex of a same chemical nature, it is those with the lowest surface tension and the highest temperature of glassy transition which give the best results. And it is the most wetting and the most rigid latex which, in combination with the PEG, give the best dimensional stabilities.

Therefore, the latex will be selected in relation to:

its chemical compatibility with the products used in any subsequent steps of transformation of the impregnated support, such as for example the compatibility of the latex with the plastisol used in the production of floor-coverings.

its surface tension and temperature of glassy transition.

Example IX-6 of this Study shows that it is possible to obtain a very good improvement of the dimensional stability, even with a wetting agent/binder ratio of 15/85. It also shows that with special binders, it is possible to reduce the quantity of wetting agent in the impregnation mixture, and to obtain a level of dimensional stability which is even higher than that of the non-impregnated support.

SCHEDULE I

Traction under cold

Tractions conducted according to the norm NF Q 03.004 of November 1971 corresponding to the norm ISO 1924/1976.

| | |
|---|---|
| Dimensions of the test pieces | 15 mm/100 mm |
| Traction time | 20 ± 5 secs. |

Traction under heat

Tractions conducted in the same operational conditions as above, except that they are conducted on test pieces which are inside an oven where the temperature is kept at 200° C.

Taber stiffness

The Taber stiffness was measured according to the norm TAPPI T489 OS-76.

Whiteness

The whiteness was determined with a photovolt by measuring the reflectance of a luminous flux at 457 mm. The measurements were taken according to the norm TAPPI T 4520M-83.

Elongation under moisture

This measurement was taken in a special cabinet where different degrees of relative moisture can be obtained (Manufacturer PRUEFBAU).

Measurements taken according to the German norm DIN 53130.

Blistering

The indicated values correspond to a visual classification of the surface aspects.

Resistance to traction delamination - RTD

This is a traction measurement taken with a dynamometer on a 5 cm-wide test bar.

The test bar is cut from a sheet coated with a layer of expanded plastisol.

For this measurement, delamination is initiated in the support sheet coated with the layer of plastisol. These two parts are locked in the dynamometer jaws.

The recorded traction value indicates the strength necessary to remove the layer of expanded plastisol from the support sheet.

Schedule II: Lists of products used.

| Product | Liquids dry matter | Chemical nature | Supplier | Surface tension mN/m |
|---|---|---|---|---|
| PEG 400 | 100 | polyethylene glycol | DOW | |
| BEROCEL 404 | 100 | polyalkylene oxide | BEROL | |
| Latex: | | | | |
| Latex 6779 | 50 | acrylic | POLYSAR | 40–45 |
| Latex EP 3030 | 44 | acrylic | POLYSAR | 38 |
| Latex 3726 | 53 | carboxylated styrene butadiene | POLYSAR | 35 |
| Latex 6106 | 49 | acrylic | POLYSAR | 36 |
| Latex 6171 | 51 | carboxylated acrylic | POLYSAR | 35 |
| Latex 3718 | 50 | carboxylated styrene butadiene | POLYSAR | <35 |
| Latex 615 | 50 | carboxylated styrene butadiene | DOW | 45–55 |
| Latex 86815 | 50 | carboxylated styrene butadiene | DOW | |
| latex CE 35 | 50 | vinyl acetate vinyl-ethylene chloride | WACKER | 35 |
| MOWILITH DM 122 | 50 | vinyl acetate vinyl-ethylene chloride | HOECHST | |
| Water-soluble binders | | | | |
| AMISOL 5591 | Powder | Starch | Ste des produits du Mais | |
| Nadavine LT | 20 | polyamide/polyamine-epichlorhydrin copolymers | Bayer | |

-continued

Schedule II: Lists of products used.

| Product | Liquids dry matter | Chemical nature | Supplier | Surface tension mN/m |
|---|---|---|---|---|
| Auxiliary products | | | | |
| NOPCO NXZ | 100 | defoamer | Diamond Shamrock | |
| CPW 09-10 | | glassfibers 4.5 mm/10 μm | VETROTEX | |
| CRAIE PR4 | Powder | calcium carbonate | Blancs Mineraux de Paris | |
| OMYALITE 60 | Powder | calcium carbonate | OMYA | |
| Aquapel C 25 | | sizing agent | HERCULES | |

TABLE I

Pure products

| | Impregnation mixtures compositions: Binders (coat-weights g/m2) | Wetting agents (coat-weights g/m2) | non-impregnated supports: D.M. % | gsm | τ | quire | Traction mach. dir. (N) Ambient temp. 200° C. | |
|---|---|---|---|---|---|---|---|---|
| I.1 | — | — | — | 235 | 274 | 1.16 | 13 | 14.4 |
| I.2 | | PEG 400 (48) | 100 | 283 | 286 | 1.01 | 57 | |
| I.3 | | PEG 400 (17) | 50 | 252 | 285 | 1.13 | 54 | 09.5 |
| I.4 | | PEG 400 (13) | 35 | 238 | 276 | 1.15 | 83 | 10.5 |
| I.5 | | BEROCEL 404 (49) | 100 | 284 | 283 | 0.99 | 50 | 02.3 |
| I.6 | | BEROCEL 404 (10) | 50 | 260 | 270 | 1.03 | 74 | 03.3 |
| I.7 | Nadavine LT (9) | | 20 | 250 | 282 | 1.12 | 116 | |
| I.8 | Kymene (5) | | 12.5 | 244 | 280 | 1.14 | 115 | |
| I.9 | Latex 6106 (20) | | 50 | 254 | 284 | 1.11 | 133 | |
| I.10 | Latex DM 122 (21) | | 50 | 255 | 284 | 1.11 | 129 | |
| I.11 | Latex Dow 615 (21) | | 50 | 245 | 280 | 1.14 | 132 | |
| I.12 | Latex 3726 (19) | | 50 | 256 | 281 | 1.09 | 135 | |
| I.13 | Latex 6171 (20) | | 50 | 261 | 286 | 1.09 | 126 | |
| I.14 | Latex 3718 (19) | | 50 | 252 | 282 | 1.11 | 143 | |
| I.15 | Latex 3718 (14) | | 35 | 241 | 278 | 1.15 | 126 | |
| I.16 | PVA 498 (9,5) | | 20 | 242 | 281 | 1.16 | 149 | 23 |
| I.17 | Amisol 5591 (8) | | 20 | 245 | 295 | 1.20 | 130 | 25 |

| | compositions: Binders (coat-weights g/m2) | Wetting agents (coat-weights g/m2) | characteristics of impregnated support, Stoved support 2 min. 200° C. support calendered once per face: Prufbau mach. dir. % elongation 65-15 % R.M. | 98-15 % R.M. | Whiteness | | TABER stiffness mach. dir. (g/cm) | after PVC coating: Blistering 160° C. | RTD 2 faces (g/cm) | Blistering 200° C. |
|---|---|---|---|---|---|---|---|---|---|---|
| I.1 | — | — | 0.11 | 0.18 | 60 | 67 | 9 | 0 | 370 | 0 |
| I.2 | | PEG 400 (48) | 0.02 | 0.07 | 50 | 42.5 | 4 | very strong | 270 | very strong |
| I.3 | | PEG 400 (17) | 0.03 | 0.08 | 56.5 | 57.5 | 4 | very slight | 350 | 0 |
| I.4 | | PEG 400 (13) | 0.06 | 0.11 | 56 | 60 | 6 | 0 | 360 | 0 |
| I.5 | | BEROCEL 404 (49) | 0.09 | 0.19 | 41.5 | 43 | 3 | very strong | 230 | |
| I.6 | | BEROCEL 404 (10) | 0.07 | 0.15 | 54 | 55 | 5 | 0 | 380 | 0 |
| I.7 | Nadavine LT (9) | | 0.09 | 0.17 | 55 | 54 | 10 | 0 | 650 | 0 |
| I.8 | Kymene (5) | | 0.09 | 0.17 | 55 | 59.5 | 11 | 0 | 420 | 0 |
| I.9 | Latex 6106 (20) | | 0.13 | 0.22 | 58.5 | 60.5 | 12 | 0 | 450 | 0 |
| I.10 | Latex DM 122 (21) | | 0.10 | 0.19 | 56.5 | 58.5 | 13 | very strong | 540 | very strong |
| I.11 | Latex Dow 615 (21) | | 0.10 | 0.17 | 54 | 52 | 12 | very strong | 55 | very slight |
| I.12 | Latex 3726 (19) | | 0.10 | 0.17 | 56 | 57.5 | 11 | very strong | 35 | very slight |
| I.13 | Latex 6171 (20) | | 0.09 | 0.17 | 58 | 59 | 11 | very strong | 510 | very slight |
| I.14 | Latex 3718 (19) | | 0.08 | 0.15 | 57 | 59 | 11 | very strong | 35 | slight |
| I.15 | Latex 3718 (14) | | 0.09 | 0.17 | 59 | 59 | 12 | strong | 80 | very slight |
| I.16 | PVA 498 (9,5) | | 0.13 | 0.20 | 56 | 57 | 14 | very strong | 370 | very strong |
| I.17 | Amisol 5591 (8) | | 0.12 | 0.19 | 60 | 54 | 13 | strong | 240 | very strong |

N.B.
D.M. Dry matter
gsm: substance (gram per sq. meter)
T: thickness μm
R.M. %: Relative moisture %
quire: thickness/substance
mach. dir.: machine direction

TABLE II

Mixtures of Binders and Wetting agents

| No. | Impregnation mixture compositions: Binders (coat-weights g/m2) | Wetting agents (coat-weights g/m2) | D.M. % | non-impregnated support: gsm | τ | quire | Traction mach. dir. (N) Ambient Temp. 200° C. |
|---|---|---|---|---|---|---|---|

TABLE II-continued

| Mixtures of Binders and Wetting agents | | | | | | | | |
|---|---|---|---|---|---|---|---|---|
| II.1 | Nadavine LT (3.7) | PEG 400 (18 5) | 50 | 262 | 285 | 1.08 | 66 | 13.5 |
| II.2 | Nadavine LT (2.0) | PEG 400 (11 0) | 30 | 250 | 278 | 1.11 | 85 | 14 |
| II.3 | Nadavine LT (3.8) | BEROCEL 404 (19 2) | 50 | 264 | 273 | 1.03 | 65 | 7 |
| II.4 | Nadavine LT (2.0) | BEROCEL 404 (11 0) | 30 | 243 | 274 | 1.12 | 82 | 8 |
| II.5 | Latex 6106 (9.8) | PEG 400 (9 8) | 50 | 251 | 285 | 1.13 | 117 | 13 |
| II.6 | Latex 6106 (6.6) | PEG 400 (6 6) | 35 | 244 | 278 | 1.13 | 119 | 14 |
| II.7 | DM 122 (6.6) | PEG 400 (6 6) | 35 | 245 | 298 | 1.21 | 139 | 13 |
| II.8 | DM 122 (10) | BEROCEL 404 (10) | 50 | 250 | 269 | 1.07 | 83 | 07 |
| II.9 | Dow 615 (6.3) | PEG 400 (6 3) | 35 | 253 | 300 | 1.18 | 154 | 11 |
| II.10 | Latex 3726 (6.3) | PEG 400 (6 3) | 35 | 246 | 281 | 1.14 | 112 | 14.6 |
| II.11 | Latex 3726 (10.9) | BEROCEL 404 (10 9) | 50 | 251 | 273 | 1.08 | 86 | 8.5 |
| II.12 | Latex 6171 (6.3) | PEG 400 (6 3) | 35 | 248 | 276 | 1.11 | 127 | 13 |
| II.13 | Latex 6171 (10.2) | BEROCEL 404 (10 2) | 50 | 257 | 285 | 1.10 | 86 | 11 |
| II.14 | Latex 3718 (10) | PEG 400 (10) | 50 | 252 | 278 | 1.10 | 94 | 13 |
| II.15 | Latex 3718 (6.2) | PEG 400 (6 2) | 35 | 251 | 276 | 1.09 | 105 | 13.5 |
| II.16 | PVA 498 (2.5) | PEG 400 (10) | 28 | 250 | 283 | 1.13 | 116 | 13 |
| II.17 | Amisol 5591 (2.5) | PEG 400 (8) | 28 | 240 | 268 | 1.11 | 125 | 13.5 |

| Impregnation mixture compositions | | | characteristics of impregnated support Stoved support 2 min. 200° C. support calendered once per face | | | | | | | |
|---|---|---|---|---|---|---|---|---|---|---|
| | | | Prufbau mach. dir. (% elongation) | | | | TABER stiffness | after PVC coating | | |
| No. | Binders (coat-weights g/m2) | Wetting agents (coat-weights g/m2) | 65-15 % R.M. | 98-15 % R.M. | Whiteness | | mach. dir. (g/cm) | Blistering 160° C. | RTD 2 faces (g/cm) | Blistering 200° C. |
| II.1 | Nadavine LT (3.7) | PEG 400 (18 5) | 0.03 | 0.07 | 59 | 60 | 8 | 0 | 390 | 0 |
| II.2 | Nadavine LT (2.0) | PEG 400 (11 0) | 0.05 | 0.08 | 61 | 64 | 9 | 0 | 370 | 0 |
| II.3 | Nadavine LT (3.8) | BEROCEL 404 (19 2) | 0.05 | 0.10 | 52 | 46 | 5 | strong | 340 | 0 |
| II.4 | Nadavine LT (2.0) | BEROCEL 404 (11 0) | 0.08 | 0.13 | 55 | 50 | 5 | slight | 360 | 0 |
| II.5 | Latex 6106 (9.8) | PEG 400 (9 8) | 0.05 | 0.085 | 53 | 58 | 9 | quite strong | 540 | quite strong |
| II.6 | Latex 6106 (6.6) | PEG 400 (6 6) | 0.06 | 0.11 | 61 | 62 | 11 | 0 | 440 | 0 |
| II.7 | DM 122 (6.6) | PEG 400 (6 6) | 0.06 | 0.11 | 60 | 62 | 10 | 0 | 435 | 0 |
| II.8 | DM 122 (10) | BEROCEL 404 (10) | 0.06 | 0.11 | 55 | 55 | 6 | strong | 430 | very slight |
| II.9 | Dow 615 (6.3) | PEG 400 (6 3) | 0.08 | 0.15 | 54 | 54 | 13 | slight | 245 | 0 |
| II.10 | Latex 3726 (6.3) | PEG 400 (6 3) | 0.06 | 0.10 | 60 | 62 | 8 | 0 | 220 | 0 |
| II.11 | Latex 3726 (10.9) | BEROCEL 404 (10 9) | 0.05 | 0.12 | 57 | 57 | 8 | very strong | 150 | very slight |
| II.12 | Latex 6171 (6.3) | PEG 400 (6 3) | 0.07 | 0.13 | 57 | 61 | 8 | 0 | 410 | 0 |
| II.13 | Latex 6171 (10.2) | BEROCEL 404 (10 2) | 0.06 | 0.15 | 55 | 56 | 8 | strong | 360 | very slight |
| II.14 | Latex 3718 (10) | PEG 400 (10) | 0.05 | 0.09 | 59 | 61 | 8 | very strong | 250 | slight |
| II.15 | Latex 3718 (6.2) | PEG 400 (6 2) | 0.07 | 0.12 | 60 | 63 | 10 | strong | 250 | very slight |
| II.16 | PVA 498 (2.5) | PEG 400 (10) | 0.06 | 0.11 | 61 | 63 | 10 | 0 | 400 | 0 |
| II.17 | Amisol 5591 (2.5) | PEG 400 (8) | 0.06 | 0.11 | 61 | 63 | 10 | 0 | 440 | 0 |

N.B.
D.M.: Dry matter
gsm: substance (gram per sq. meter)
T: thickness μm
R.M. %: Relative moisture %
quire: thickness/substance
mach. dir.: machine direction

TABLE III

| Impregnation moisture Compositions | | | | | | | | Characteristics of impregnated support | | | |
|---|---|---|---|---|---|---|---|---|---|---|---|
| | | | | | | | | stoved support 2 mins. 200° C. | | calendered support | |
| | | | | | | | Traction machine direction (N) | Prufbau arc. dir. (elongation %) | | TABER stiffness machine direction (g/cm) | |
| No. | Binders (coat-weights g/m2) | Wetting agents (coat-weights g/m2) | non-impregnated support D.M. % | gsm | τ | quire | Ambient Temp. 200° C. | 65-15 R.M. % | 98-15 R.M. % | | Picking |
| III.1 | — | — | — | 148 | 250 | 1.68 | 75 | 0.25 | 0.51 | 18 | quite strong |
| III.2 | — | PEG 400 (48) | 50 | 208 | 300 | 1.44 | 20 | 0.09 | 0.19 | 10 | slight |
| III.3 | DM 122 (32) | — | 50 | 179 | 238 | 1.60 | 53 | 0.21 | 0.48 | 25 | 0 |
| III.4 | Nadavine LT (12) | — | 20 | 168 | 298 | 1.77 | 74 | 0.22 | 0.45 | 16 | quite strong |
| III.5 | DM 122 (18) | PEG 400 (18) | 50 | 183 | 289 | 1.58 | 40 | 0.11 | 0.16 | 14 | 0 |
| III.6 | Nadavine LT (7) | PEG 400 (35) | 50 | 185 | 310 | 1.67 | 37 | 0.03 | 0.07 | 15 | very slight |
| III.7 | Nadavine LT (3,5) | PEG 400 (18) | 25 | 169 | 310 | 1.83 | | 0.19 | 0.24 | 17 | very slight |

N.B.
D.M.: Dry matter
gsm: substance(gram per sq. meter)
T: Thickness (μm)
R.M. %: Relative moisture %
quire: Thickness/substance
acr.dir.: across direction

TABLE IV*

| Impregnation mixtures compositions | | | | Characteristics of impregnated support | | | | | | |
|---|---|---|---|---|---|---|---|---|---|---|
| Binders coat-weights | Wetting agents (coat-weights g/m2) | ES | Paper condition | PRUFBAU R.M. % | | | | | Stiffness M.D. | traction M.D. |
| No g/m2) dry | dry | % | aspect | 65-15 | 98-15 | g/m2 | opacity | Whiteness | g/cm | N |
| — | — | — | N.T.R. | 0.35 | 0.97 | 107 | 92 | 1 | 4.0 | 55.5 |
| Latex 3726 (16) | — | 35 | N.T.R. | 0.30 | 0.76 | 122 | 89.5 | 1 | 4.7 | 102.2 |
| Nadavine LT (12) | — | 20 | N.T.R. | 0.32 | 0.80 | 119 | 92 | 1 | 3.3 | 83.2 |
| — | BEROCEL 404 (92) | 100 | very greasy | 0.21 | 0.82 | 198 | 62.5 | 4 | 2.7 | 24.5 |
| — | PEG 400 (99) | 100 | very greasy | 0.05 | 0.34 | 194 | 61.2 | 3 | 1.2 | 16.3 |
| — | PEG 400 (43) | 50 | greasy | 0.17 | 0.51 | 157 | 71.5 | 3 | 1.0 | 14.7 |
| Navadine LT (7.7) | PEG 400 (38.3) | 50 | slightly greasy | 0.08 | 0.24 | 154 | 75.6 | 3 | 1.8 | 31.5 |
| Navadine LT (1.8) | PEG 400 (9.2) | 25 | N.T.R. | 0.31 | 0.58 | 116 | 92.0 | 2 | 2.8 | 44.2 |
| Navadine LT (8.3) | BEROCEL 404 (41.7) | 50 | slightly greasy | 0.21 | 0.61 | 158 | 72.0 | 4 | 2.6 | 42.7 |
| Navadine LT (4.3) | BEROCEL 404 (21.7) | 25 | slightly greasy | 0.06 | 0.26 | 138 | 88.2 | 3 | 2.1 | 31.4 |
| Latex 3726 (21) | PEG 400 (21) | 50 | slightly greasy | 0.11 | 0.20 | 150 | 77.0 | 2 | 2.6 | 53 |
| Latex 3726 (11) | PEG 400 (11) | 35 | slightly greasy | 0.29 | 0.62 | 129 | 89.0 | 1 | 3.7 | 85 |

N.B. Whiteness:
1 very white
2 slightly yellowish
3 yellowish
4 very yellow
*%
N.T.R.: nothing to report
M.D.: machine direction

TABLE V

| | Non-impregnated sheet | Impregnated sheet |
|---|---|---|
| Substance (g/m2) | 297 | 322 |
| Thickness (μm) | 304 | 305 |
| quire $\left(\frac{\mu m \cdot m^2}{g}\right)$ | 1.02 | 0.95 |
| Taber stiffness | 11 | 9 |
| Machine direction (g/cm) | | |
| Across direction (g/cm) | 9 | 4 |
| Hot traction (N) | 13 | 7 |
| 2 min. —200° C. | | |
| RTD (g/cm) | 320 | 350 |
| Prufbau (% elongation) | | |
| 65 - 15% RM | 0.11% | 0.06% |
| 98 - 15% RM | 0.18% | 0.12% |

TABLE V

| | bis latex 2671 BEROCEL 404 | latex 6106 PEG 400 |
|---|---|---|
| substance (g/m) | 307 | 297 |
| thickness (μm) | 297 | 314 |
| quire (μm · m²/g) | 0.96 | 1.05 |
| Taber stiffness (g/cm) | 7 | 9 |
| machine direction | | |
| across direction | 4 | 4 |
| hot traction (N) | | |
| 2 mins-200° C. | 7 | 13 |
| RTD (g/cm) | 380 | 380 |
| Prufbau (% elongation) | | |
| 65 - 15% R.M. | 0.06% | 0.06% |
| 98 - 15% R.M. | 0.12% | 0.10% |

Non-impregnated support 282 g/m2

TABLE VI

| | Non-impregnated sheet | Impregnated sheet |
|---|---|---|
| substance (g/m²) | 204 | 227 |
| thickness (μm) | 349 | 335 |
| quire (μm · m²/g) | 1.71 | 1.45 |

TABLE VI-continued

| | Non-impregnated sheet | Impregnated sheet |
|---|---|---|
| Taper stiffness (g/cm) | 27 | 24 |
| machine direction | | |
| across direction | 17 | 14 |
| cold traction (N) | 169 | 167 |
| machine dir. (kg) | | |
| hot traction (N) | 22 | 16 |
| 2 mins-200° C. | | |
| machine direction | | |
| RTD 2 faces g/cm | 255 | 290 |
| Prufbau (% elongation) | | |
| 65 - 15% R.M. | 0.10% | 0.05% |
| 98 - 15% R.M. | 0.19% | 0.09% |

TABLE VII

| | MP 19 863 | | MP 19 865 | |
|---|---|---|---|---|
| Non-impregnated supports | | | | |
| Glassfibers | 4 | | 2.5 | |
| substance (g/m) | 139.6 | | 133.6 | |
| thickness (μm) | 207 | | 191 | |
| quire (μm.m /g) | 1.48 | | 1.43 | |
| ashes % | 35.2 | | 34.5 | |
| coat-weight g/m2 | — | — | 10* | 20* |
| Dimensional Stability | | | | |
| Stoved for 2 mins. at 200° C. (FENCHEL) (% elongation) | 0.60 | 0.89 | 0.43 | 0.3 |
| Cold break (N) | | | | |
| machine direction | 47.6 | 52 | 53 | 46 |
| across direction | 21.8 | 21.6 | — | — |
| Hot break (N) | | | | |
| machine direction | 8.7 | 11.4 | 13 | 13 |
| TABER stiffness (g/cm) | | | | |
| machine direction | — | 3.4 | 3.2 | 2.9 |
| across direction | — | 1.3 | 1.7 | 1.6 |

Impregnation mixtures:
*Latex EP 3030 50% by dry weight
PEG 400 50% by dry weight

TABLE VIII

| | IMPREGNATION MIXTURES | | | | | IMPREGNATED SHEETS | |
|---|---|---|---|---|---|---|---|
| | COMPOSITIONS Latex-Wetting Agent (% by weight) | | COAT-WEIGHTS (g/m2) | | | DIMENSIONAL STABILITY | BLISTERING |
| | | | total | Latex | Wetting agent | *(% elongation) | (Appreciation) |
| VIII 1 | EP 3030 | PEG 400 | 19.3 | 9.65 | 9.65 | 0.28 | strong |
| | (50) | (50) | 10.7 | 5.35 | 5.35 | 0.35 | quite strong |
| VIII 2 | (67) | (33) | 17.1 | 11.4 | 5.7 | 0.30 | average to strong |
| | | | 10.0 | 6.7 | 3.3 | 0.39 | poor to average |
| VIII 3 | (75) | (25) | 15.9 | 12.0 | 4.0 | 0.33 | poor |
| | | | 9.3 | 7.0 | 2.3 | 0.48 | very poor |
| VIII 4 | (85) | (15) | 13.2 | 11.2 | 2.0 | 0.47 | none |
| VIII 5 | EP 3030 | PEG 600 | 20.5 | 10.25 | 10.25 | 0.21 | strong |
| | (50) | (50) | 10.9 | 5.45 | 5.45 | — | quite strong |
| VIII 6 | (75) | (25) | 16.0 | 12.0 | 4.0 | 0.31 | poor |
| | | | 9.9 | 7.5 | 2.5 | — | very poor |
| VIII 7 | EP 3030 | BEROL 404 | 20.3 | 10.15 | 10.15 | 0.32 | — |
| | (50) | (50) | 9.4 | 4.7 | 4.7 | — | — |
| VIII 8 | (75) | (25) | 17.8 | 13.35 | 4.45 | 0.38 | poor |
| | | | 9.6 | 7.2 | 2.4 | — | none |
| VIII 9 | CE 35 | PEG 400 | 19.5 | 9.75 | 9.75 | 0.22 | strong |
| | (50) | (50) | 10.0 | 5.0 | 5.0 | 0.35 | quite strong |
| VIII 10 | (75) | (25) | 20.2 | 15.15 | 5.05 | 0.30 | poor to average |
| | | | 11.0 | 8.25 | 2.75 | 0.36 | poor |

The non-impregnated sheet MP 20 710 has a gsm substance of 135 g/m2 and a dimensional stability of 0.8%
*Measurement done with a FENCHEL type apparatus after 8 mins. immersion in water.

TABLE IX

| TEST | LATEX CHEMICAL NATURE | REFERENCE | SURFACE TENSION (mN/m) | TEMPERATURE OF GLASSY TRANSITION (°C.) | DIMENSIONAL STABILITY* (% elongation) |
|---|---|---|---|---|---|
| IX.1 | Carboxylated styrene butadiene | POLYSAR 3726 | <35 | +3 | 0.68 |
| IX.2 | Carboxylated styrene butadiene | POLYSAR 3718 | 35 | +8 | 0.60 |
| IX.3 | Acrylic | POLYSAR 6779 | 40–45 | −4 | 0.85 |
| IX.4 | Acrylic | POLYSAR 6106 | 36 | +24 | 0.65 |
| IX.5 | Acrylic | POLYSAR EP 3030 | 38 | +45 | 0.43 |
| IX.6 | Ethylene/vinyl chloride/vinyl acetate terpolymer | WACKER-CE 35 | 35 | +45 | 0.29 |

*Dimensional stability measured with a FENCHEL type apparatus - 8 mins.-immersion in water
The non-impregnated support has a dimensional stability of 1.35%.

What is claimed is:

1. A process for improving the dimensional stability of a fibrous sheet obtained by a papermaking process, said sheet being made of fibers, at least a part of which are hydrophilic fibers, wherein said sheet is impregnated with a non-foaming chemical composition containing at least one wetting agent selected from the group consisting of polyglycols and derivatives thereof, and an aqueous solution of polyamide-polyamine-epichlorhydrin resin.

2. A process for improving the dimensional stability of a fibrous sheet containing cellulosic fibers for coating supports for floor and wall coverings obtained by a papermaking process which comprises impregnating said sheet with a chemical composition containing polyethylene- glycol and an aqueous solution of polyamide-polyamine-epichlorhydrin resin.

3. A process for improving the dimensional stability of a fibrous sheet containing cellulosic fibers for coating supports for floor and wall coverings obtained by a papermaking process which comprises impregnating said sheet with a chemical composition containing at least one wetting agent selected from the group consisting of polyglycols and derivatives thereof, and at least one organic binder selected from the group consisting of SBR, acrylic and PVC polymers, vinylactate-vinylchloride-ethylene terpolysers, wherein the impregnating mixture contains at least 15 parts by weight of wetting agent for 100 parts by dry weight of binder and wetting agent, and the binder is in the form of a synthetic latex which has a surface tension of less than 40 mN/m.

4. A floor or wall covering support formed from a fibrous sheet containing cellulosic fibers obtained by a papermaking process which comprises impregnating said sheet with a chemical composition containing at least one wetting agent select from the group consisting of polyglycols and derivatives thereof, and at least one organic binder selected from the group consisting of SBR, acrylic and PVC polymers, vinyl-acetate-vinylchloride-ethylene terpolymers, starch, polyvinylic alcohols, and polyamide-polyamine-epichlorhydrin resins.

* * * * *

UNITED STATES PATENT AND TRADEMARK OFFICE

CERTIFICATE OF CORRECTION

PATENT NO. : 4,710,422

DATED : December 1, 1987

INVENTOR(S) : FREDENUCCI

It is certified that error appears in the above-identified patent and that said Letters Patent is hereby corrected as shown below:

Column 4, line 57, "EP 145222" should read --EP 145522--.

Column 8, line 21, after 'PEG 400®', insert --yields--.

Column 9, line 55, after 'latex 6171®', insert --increases--.

Column 11, line 5, "0.58%" should read --0.85%--.

Column 16, Table I, penultimate column, first line, "13" should read --113.--

Signed and Sealed this

Nineteenth Day of July, 1988

*Attest:*

DONALD J. QUIGG

*Attesting Officer*

*Commissioner of Patents and Trademarks*